United States Patent [19]

Cole

[11] Patent Number: 4,910,880

[45] Date of Patent: Mar. 27, 1990

[54] MULTIOPERATIONAL TREATMENT APPARATUS AND METHOD FOR DRYING AND THE LIKE

[75] Inventor: Keith Cole, Battle Creek, Mich.

[73] Assignee: General Foods Corporation, White Plains, N.Y.

[21] Appl. No.: 247,207

[22] Filed: Sep. 21, 1988

[51] Int. Cl.[4] ..... F26B 3/08

[52] U.S. Cl. ..... 34/10; 34/57 A; 34/57 B; 432/58

[58] Field of Search ..... 34/57 A, 57 R, 57 B, 34/10, 164; 432/58

[56] References Cited

U.S. PATENT DOCUMENTS 3,262,217 7/1966 Brown et al. ..... 34/164

3,492,740 2/1970 Geipel et al. ..... 34/57 A

FOREIGN PATENT DOCUMENTS 606065 4/1978 U.S.S.R. ..... 34/57 A

*Primary Examiner*—Henry A. Bennet

*Attorney, Agent, or Firm*—Sam D. Walker; Thomas R. Savoie; Daniel J. Donovan

[57] ABSTRACT

An apparatus and method for drying or otherwise treating materials within a controlled environment are provided. Included is a combination of features that imparts a fluidized state to particulate materials on a foraminous conveyor belt, which features also permit selecting other modes of operation including downflow of treating gas to and through the foraminous conveyor belt and upflow of treating gas to and through the foraminous conveyor belt. By this arrangement, a single apparatus can be used to accomplish a plurality of different treatments by selectively adjusting treatment variables.

29 Claims, 7 Drawing Sheets

MULTIOPERATIONAL TREATMENT APPARATUS AND METHOD FOR DRYING AND THE LIKE

BACKGROUND AND DESCRIPTION OF THE INVENTION

The present invention generally relates to an apparatus and method for drying or otherwise treating materials that are conveyed through an enclosed treating environment. More particularly, the invention relates to an especially versatile apparatus and method that allow the operator to select among a variety of operational modes. Treated gases, such as heated air and the like, are able to be circulated through a variety of paths and combinations of movement that are designed to present different types of treatments and conditions to the material being treated. Included is an assembly that conveys a foraminous belt, and the treated gas path can be selected including downwardly through materials on the belt, upwardly therethrough and by an arrangement in which the materials being treated are subjected to fluidized bed conveyed conditions under which particulate materials are generally tumbled along the foraminous conveyed belt. By virtu of this invention, a single piece of equipment ca be easily adjusted so as to carry out a number of different treatment procedures that are needed for processing or treating a variety of different products, such as different dry cereal products.

Dryers, ovens, refrigeration units, and the like have been provided which circulate treated gases such as heated, pressurized air for intimate, treated contact with a variety of different products, including food products, as well as granulated or particulate materials, such as dry cereals, as well as numerous other non-edible and edible items. Typically, these devices are designed to perform primarily a single function, such as baking pizzas, making crackers, baking cookies, drying chemicals, or carrying out a particular stage in the manufacture of a particular type of dry cereal.

With particular reference to the dry cereal processing industry, cereal products of different types required different processing or treating steps. Most dry cereal products require multiple treatment steps, each necessitating a type of drying or treating apparatus that may not be suitable for any other type of treatment or processing step. For example, at certain stages, some dry cereal product preparations call for an apparatus that will permit alternating upflow and downflow of dry air through the cereal preparation as it is being conveyed through the apparatus. Such an approach may be needed, for example, for continuous cooked flake products that need to remain substantially stationary on the moving conveyor bed. Sometimes it is important to minimize movement of the cereal particulates while they are on the conveyed surface in order to achieve flavor and vitamin retention.

Other dry cereal products may require a puff-toasting or a blister-toasting procedure that can be carried out under relatively severe conditions in order to impart a particular property such as color and/or flavor development to the ultimately produced dry cereal product. Some cereal products are best prepared by including treatment with a so called fluidized bed apparatus which typically includes a solid conveyor and relies upon pressurized gas impingement onto the top surface of this solid conveyor in order to tumble or turn individual particles to thereby affect special treatments or to provide especially efficient treatment procedures. For example, grain grits can be subjected to special treatments to form same first into cup-shaped, thin flakes and then puff-toast them into thicker and larger flakes or to blister-toast them into blistered and wrinkled flakes under high temperature, short time fluidized bed conditions. Without this type of treatment, materials, such as grain grits, would form unsatisfactory flakes that look similar to fish scales.

Certain other cereal products cannot be suitably processed with this fluidized bed impingement type of equipment because the rather violent impingement activity will damage the granules. An example of a cereal of this type is one having a coating, such as a sugar coating, which will be removed from the product by frictional engagement with the pressurized air jets and with the solid conveyor surface upon which the air jets impinge. Other equipment is often needed to accomplish other procedures having their own respective time, temperature and product movement conditions and requirements.

Examples of equipment used heretofore in the cereal industry, as well as in other industries, in order to perform certain types of drying or other processing operations include the impingement type of systems such as those illustrated by U.S. Pat. Nos. 3,060,590 and 3,229,377, as well as by 3,262,217 which also includes the provision of a vibrating conveyor onto which impingement takes place. While these types of devices which basically operate on air impingement principles can be useful for certain types of applications, they do not provide the kind of versatility that can reduce the capital outlay and floor space needed for processing a variety of different products such as a full line of dry cereal products. Other devices that are useful but are of limited versatility, include those of the traveling screen type in which the products being processed are spread on a screen which is conveyed through a heated or otherwise conditioned environment. This type of an apparatus will not allow for the formation and use of a fluidized bed, and it is not particularly suitable for performing puffing or toasting operations or other procedures.

It has been found that, by proceeding in accordance with the present invention, it is possible to provide numerous types of treatment functions within a single piece of equipment. The equipment can proceed to provide operating conditions of the type provided by a traveling screen drying apparatus, while permitting adjustments in conditions to transform same into an apparatus that provides a fluidized bed to levitate and tumble the materials while subjecting them to desired time, flow and temperature conditions.

In summary, the present invention is an apparatus and method that incorporates a foraminous conveyor surface which can, when desired, be transformed into a fluidization surface that operates in the nature of a device that incorporates impingement of gas jets onto an imperforate surface along which the materials being treated are conveyed. In addition, means are provided for selectively varying the circulation path and movement velocity of the gaseous treatment fluid. Included in the means for varying the treatment procedures accomplished by the present invention is the use of a lower plenum beneath a foraminous conveyor belt, coupled with means for varying pressure exerted by the fluid within the lower plenum onto the foraminous conveyor.

It is a general object of the present invention to provide an improved apparatus and method for imparting treating fluid to materials passed through a treatment zone.

Another object of this invention is to provide an improved drying and treating apparatus and method that embody multioperational features within a single unit.

Another object of the present invention is to provide an improved apparatus and method for performing a variety of different drying or other treatment operations by modifying parameters of the treatment fluid.

Another object of this invention is to provide an improved apparatus and method for multioperational drying, toasting, or otherwise treating cereal materials with supplies of flowing gas.

Another object of this invention is to provide an improved apparatus and method wherein fluidized bed conditions can be provided without requiring an imperforate impingement surface.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
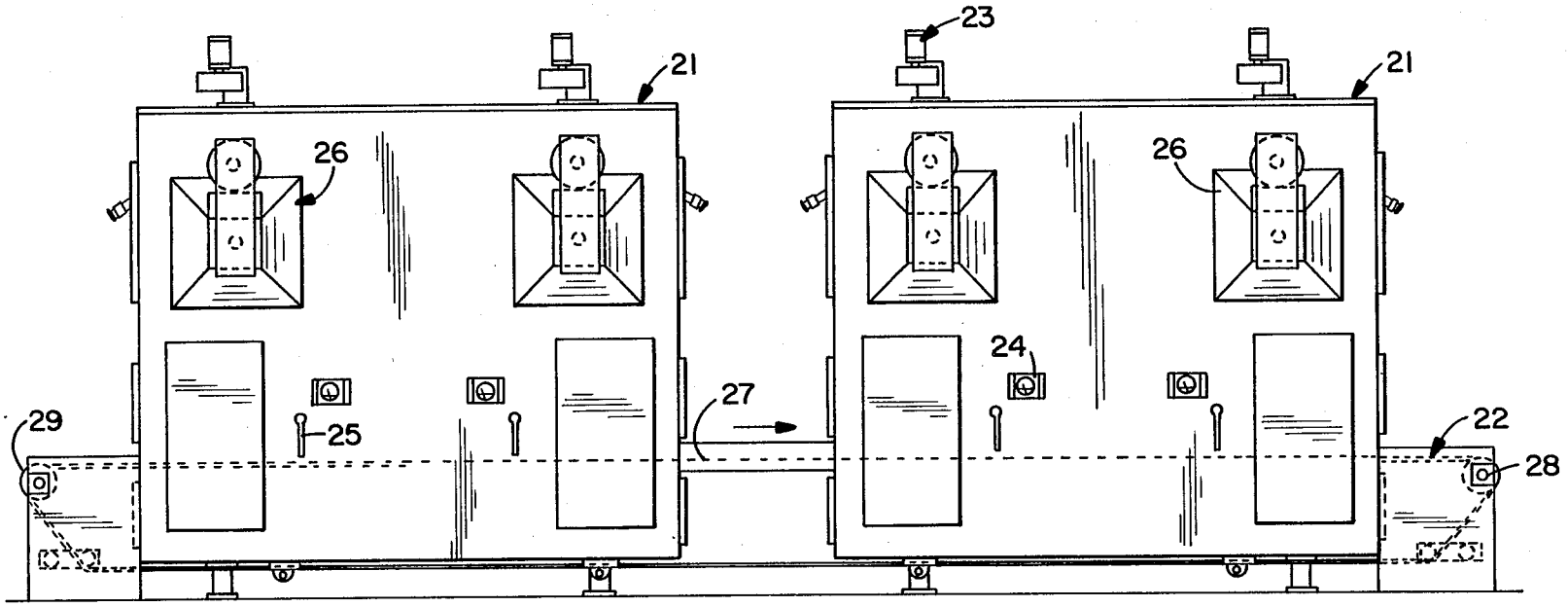
FIG. 1 is a side elevational view of an apparatus according to this invention.

A multioperational drying or cooking apparatus is illustrated in FIG. 1. A plurality of enclosure assemblies, generally designated as 21, are shown. A conveyor assembly, generally designated as 22, is shown as a continuous unit that joins the enclosure assemblies 21. As illustrated, each enclosure assembly includes two separately controllable treatment zones. In some applications, but a single enclosure assembly may be provided with greater numbers of treatment zones. In other versions, each enclosure assembly could have its own separate conveyor assembly, and other processing steps could be carried out therebetween. Another option which is available when using a conveyor assembly, such as the preferred flexible conveyor assembly, is to have the conveyor assembly continue onto a different treating station or stations positioned between the enclosure assemblies 21.

Each enclosure assembly 21 includes gas conditioning means, such as a burner assembly 23. Means are also provided, as discussed in greater detail herein, for pressurizing the conditioning gas, for directing same, and for circulating same through a variety a different paths and path combinations, depending upon the particular treating, drying or baking function and the like to be performed within the enclosure assembly 21. Controls including gauges 24 and air seal dampers 25 are generally illustrated. Circulating fan assemblies 26 are also generally shown in FIG. 1.

Figure 7:
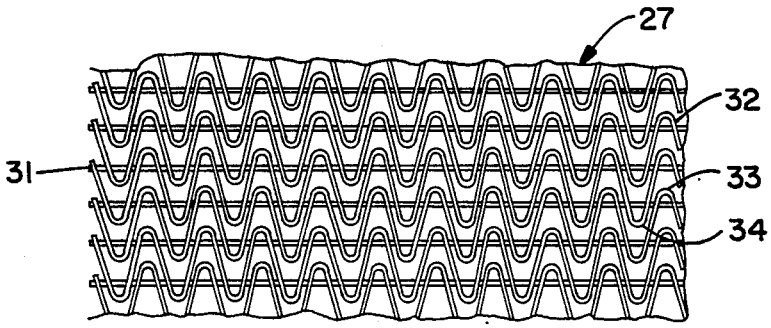
FIG. 7 is a detail view of a portion of the preferred foraminous belt included in accordance with the present invention.

Conveyor assembly 22 includes an endless foraminous conveyor belt 27 mounted along pulley assemblies in a generally known manner. Included are a drive pulley assembly and a driven pulley assembly 29, as well as other takeup pulleys and the like, the details of which will be appreciated by one of skill in the art. The preferred structure of the foraminous conveyor belt 27 is illustrated in FIG. 7. It can be characterized as woven metal wire that is capable of an extremely full range of movement in the direction of travel. Such movement capabilities include being able to readily follow inclined paths to move from equipment of differing treatment heights and being able to wind around conveyor pulleys and drive pulleys of relatively small diameter.

The illustrated foraminous conveyor belt 27 includes a plurality of generally parallel rods 31 which are generally threaded through so as to join alternating and generally mating accordian or zig-zag flights 32. The rods 31 join the flights 32 by pivotally connecting forward bends 33 of one flight 32 in alternating fashion with rearward bends 34 of an adjacent flight 32. Preferably, the rods 31 and the flights 32 are made of stainless steel or other durable and rigid material that is able to withstand the temperatures applied on the unit and is safe for use with food products.

Figure 2:
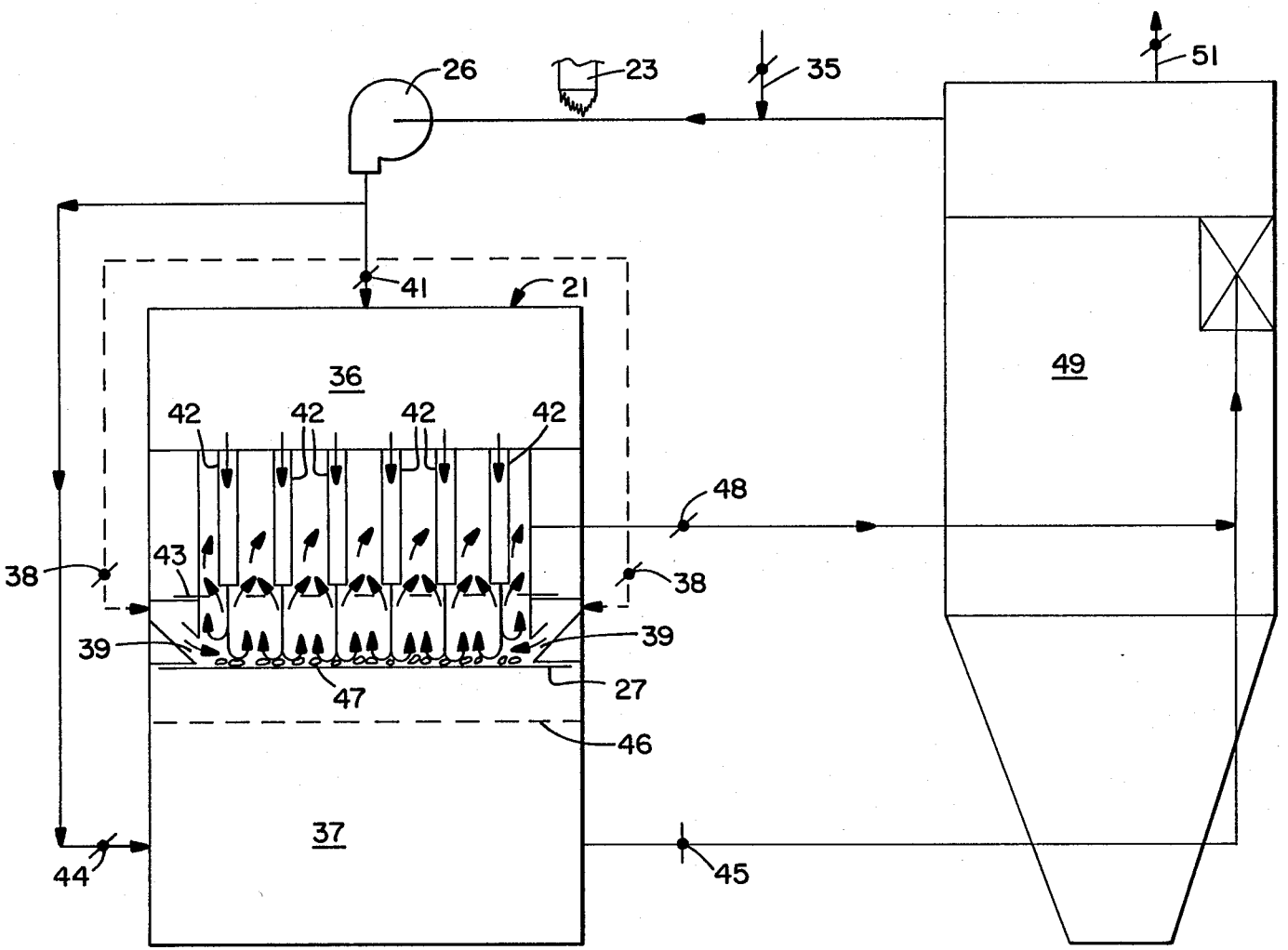
FIG. 2 is a generally schematic illustration of an embodiment of the invention which shows the fluidizing gas circulation according to the present invention.

FIG. 2 illustrates the operation of the present invention in a manner in which fluidized bed conditions are presented above the foraminous belt 27 of the conveyor assembly. The circulating fan assembly 26 provides a supply of pressurized gas, such as air, which may, for example, be heated by means of the burner assembly 23. While the illustrated apparatus recirculates the treating gas, make-up gas or air can be added as needed at 35 in order to vary or maintain gas temperature, drying characteristics and the like. The pressurized gas is passed through suitable conduits for passage into an upper plenum 36 and a lower plenum 37. When desired, side streams of gas from the circulating fan assembly 26 can be provided. The side stream flow is typically monitored by dampers or valves 38, and the gaseous flow exits onto the longitudinal edges of the foraminous belt 27 through suitable elongated slots 39 or the like. This longitudinal side stream arrangement assists in maintaining the materials being treated on the foraminous belt 27, while also assisting in maintaining the fluidized condition provided by this mode of operation of the invention.

Figure 3:
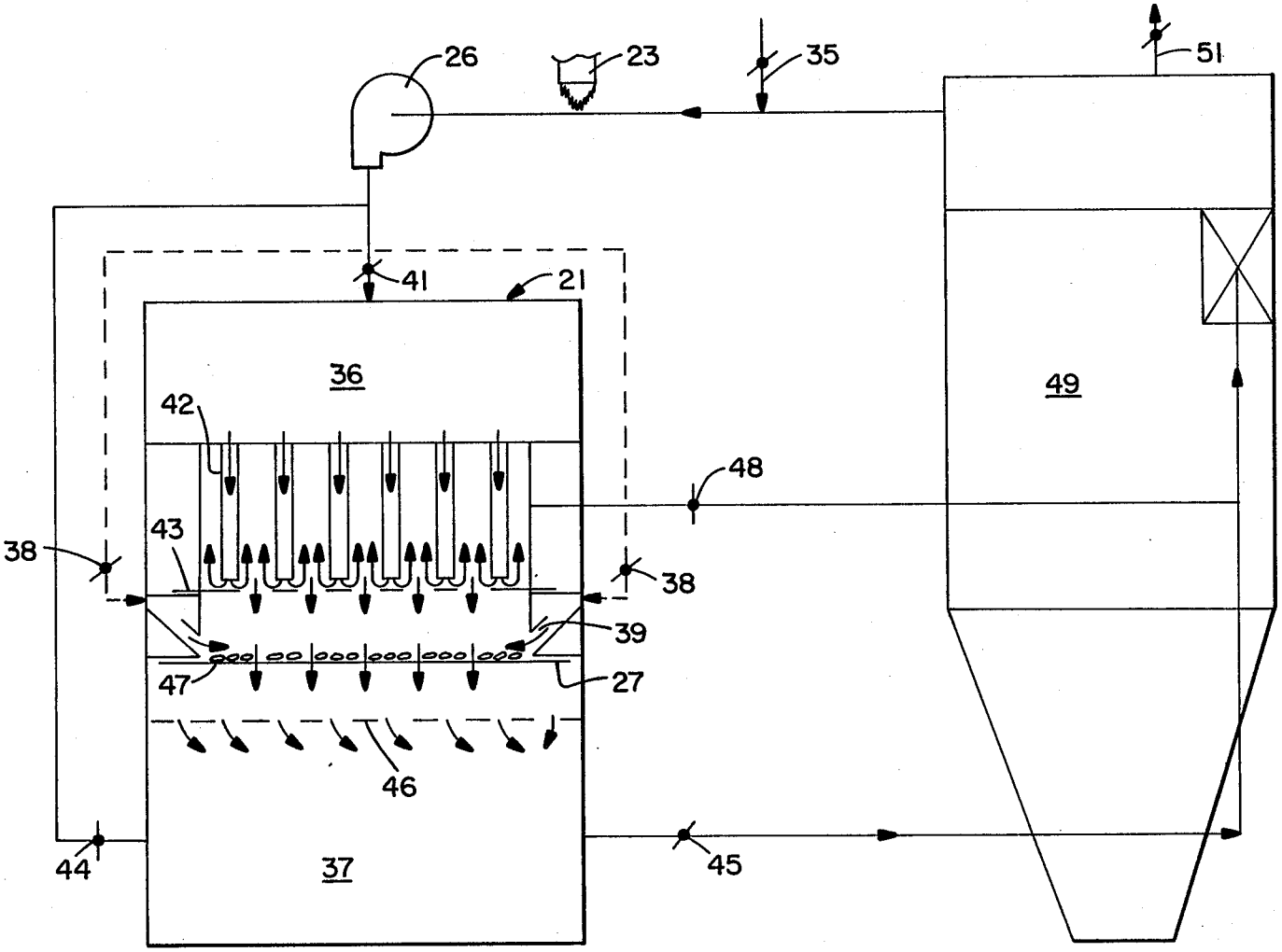
FIG. 3 is a generally schematic illustration of an embodiment of the invention which shows the downflow gas circulation through the bed according to the present invention.
Figure 4:
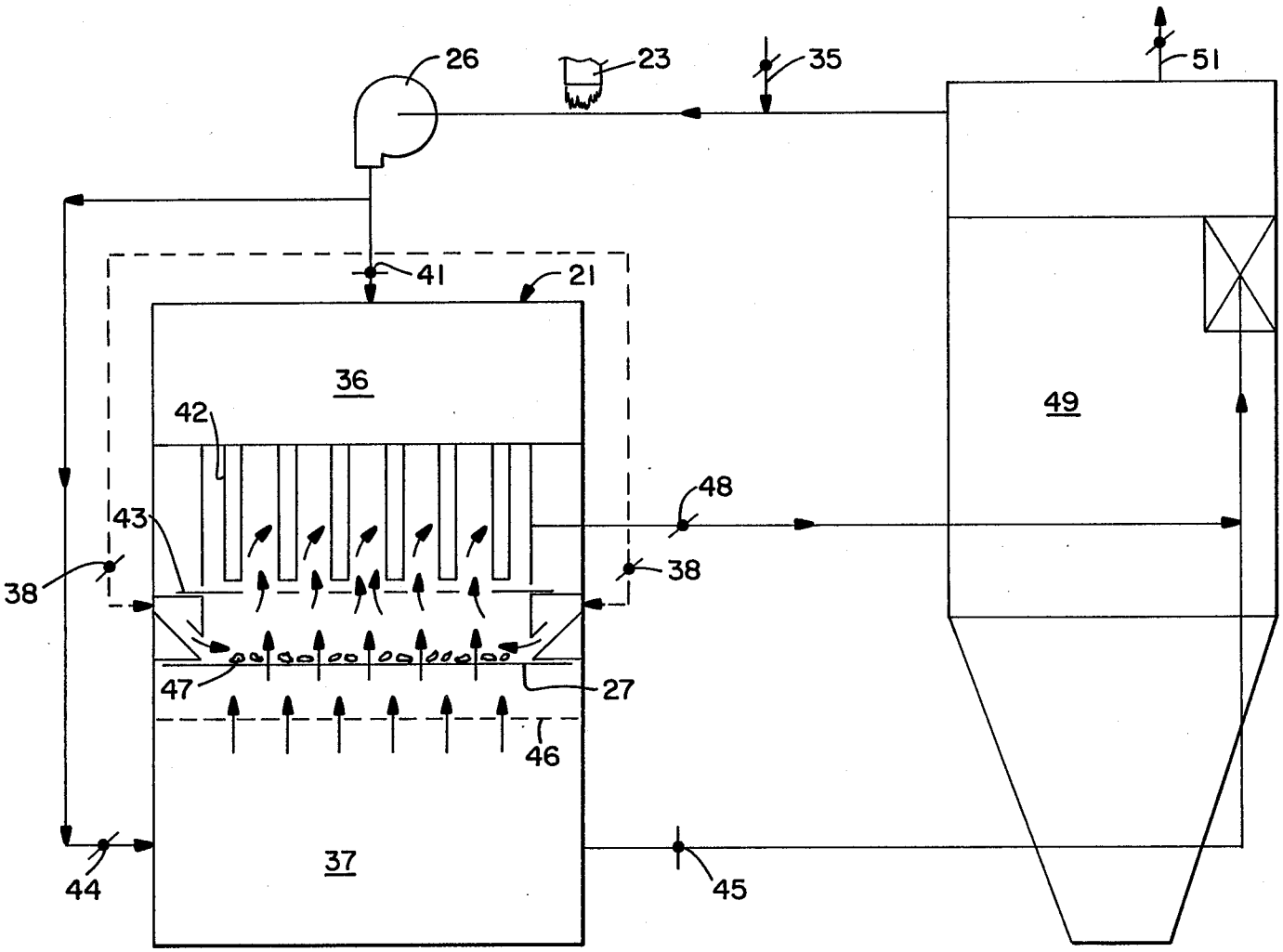
FIG. 4 is a generally schematic illustration of an embodiment of the invention which shows the upflow gas circulation through the bed according to the present invention.

With more particular reference to the fluidization that is achieved by this mode of operation, the circulating fan assembly 26 and/or a damper or valve 41 upstream of the upper plenum 36 permit adjustment of the pressurization of the gas, such as air, within the upper plenum 36, which is preferably closely monitored. This pressurized source is then directed downwardly by suitable directing devices, such as the illustrated plurality of tubes 42. Passage of this pressurized air through such directing devices will, of course, increase the velocity of the gas flowing therethrough. This velocity can be adjusted by any suitable means, such as the known means of providing a sliding or movable hole plate 43 so that holes therein are moved into or out of alignment with outlets of the directing tubes 42 or the like. Different positioning in this regard is illustrated in FIGS. 2, 3 and 4. The result of the various adjustment features is that output from the directing devices 42 is variable and is oriented generally downwardly toward the foraminous conveyor 27.

The pressurized gas entering the lower plenum 37 builds a desired pressure of gas within the lower plenum 37. This pressure can be provided, maintained and/or monitored by a damper or valve 44, the circulating fan assembly 26, and the like. If necessary, a damper or valve 45 could be opened to adjust the pressure within the lower plenum 37, although this damper 45 will typically be closed during this mode of operation. In accordance with generally known principles, one or more perforated distribution plates 46 can be provided in order to further direct gas flow or control pressure within the lower plenum 37.

According to the mode illustrated in FIG. 2, the primary path out of the lower plenum 37 is through the foraminous conveyor belt 27, the plenum being substantially closed on all sides except for its upper portion that directly underlies the foraminous conveyor belt 27. By this arrangement, the generally downwardly-directed gaseous flow from the upper plenum 36 impinges upon a pressurized gas layer that is provided at the boundary where the downflow gas meets the upflow gas. This boundary may be considered to be a generally horizontal curtain provided at or just slightly above the foraminous conveyor belt 27 which is generally provided by the pressurized gas of the lower plenum 37. Typically, the fluidized bed conditions of this invention are achieved when the upward flow from the lower plenum is between about 30 percent and about 80 percent of the downward flow from the directing devices.

Particulate materials 47, which can be cereal flakes, nuggets, granules, puffs or the like, generally tumble along the foraminous conveyor belt 27, but they do not pass therethrough to any significant degree. This action, which is generally illustrated by curved, arrow-headed lines in FIG. 2, generally levitates, rolls, tumbles or fluidizes the particulate materials 47 along, with and generally above the foraminous conveyor belt 27. Also, generally in accordance with impingement types of drying or treating devices, the pressurized air that fluidizes the particulate materials 47 simultaneously impinges upon these materials as they are tumbled, turned and moved, with the result that treatment of the particulate materials 47 with this treating gas is enhanced.

The treating gas then floss out of the enclosure assembly 21 in a manner that is generally appreciated in the art, typically by way of an outlet assembly including a damper or valve 48 for transmission to a cyclone assembly 49 or the like for removing undesirable materials from, or otherwise treating, the gaseous medium recirculating through the apparatus. Certain such gaseous medium can exit the cyclone apparatus by a typical exhaust arrangement 51, which can be useful to maintain temperature nd drying characteristics, all in accordance with generally known principles.

By the mode or arrangement illustrated in FIG. 2, the particulate materials 47 are subjected to fluidized bed conditions in the nature of those developed by dryer or treatment devices utilizing impingement principles in which a downwardly directed flow of pressurized gas impinges upon an imperforate and rigid surface. This is accomplished even though no such imperforate impingement surface is provided. Typical conditions that are needed in this regard for dry cereal processing include relatively high temperatures, on the order of about 400° to 550° F. and somewhat brief treatment times, on the order of about 30 to about 90 seconds, while air velocities out of the directing devices will be in the range of approximately 8000 to approximately 12,000 feet per minute. Moisture levels can be reduced from a range on the general order of 15 to 20 percent down to about 2 percent.

With reference to FIG. 3, the particulate materials 47 are subjected to a downward flow therethrough of treatment gas from the upper plenum 36 while these materials 47 are generally positioned on the foraminous conveyor belt 27. Damper or valve 48 is substantially closed, and the bulk of the volume of treatment gas then enters the lower plenum 37, which is at a lower pressure than that of the upper plenum 36. The flow is then passed out of the lower plenum 37 and is circulated o the cyclone assembly 49 by opening the damper or valve 45.

Drying, cooking or treating operations of the type that can be carried out on a so-called traveling screen assembly can suitably be accomplished according to this mode of operation. For example, dry cereal flakes such as bran flakes are typically dried or treated with an upflow through the bed of flakes (which could be carried out by the present invention when in the mode illustrated in FIG. 4), and they are then subjected to downflow drying conditions that are typically more efficient than upflow drying. An example of a typical downflow drying operation would use air at between 250° and 300° F., air flows of on the order of about 200 to 300 feet per minute, and retention times of on the order of a few minutes. A typical flaked product will then be dried to a moisture level of about 2 to 3 percent.

The operational mode or FIG. 4 is one in which there is an upflow of treatment gas through the bed of particulate materials 47. Treatment requiring upflow of gas through particulate material can be practiced when the invention is adjusted according to this mode. Damper or valve 45 is substantially closed, and the pressurized air flowing through the damper or valve 44 pressurizes the lower plenum 37. With this arrangement, treatment gases pass upwardly through the foraminous or woven metal conveyor 27 in order to thereby treat particulate material 47 thereon, after which flow continues through damper or valve 48 for return to the cyclone 49 and typically the damper or valve 41 is closed. With reference to dry cereal processing, this upflow mode, for example, can be used to provide initial surface drying of flakes in order to prevent both sticking to the conveyor belt and matting of the flakes, which initially can have a moisture content in the approximate 20% range.

Figure 5:
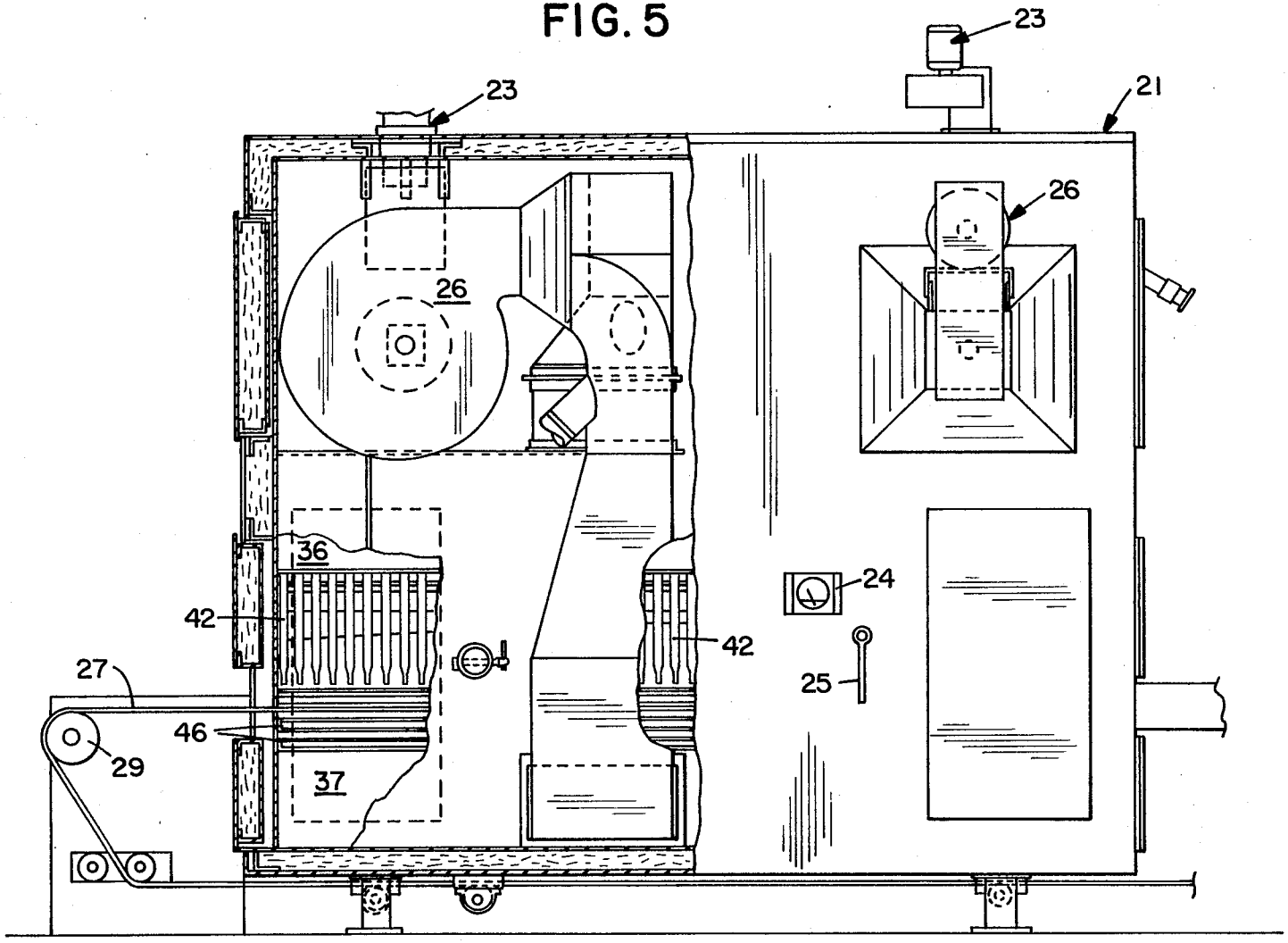
FIG. 5 is a more detailed elevational view, partially cut away, of a portion of the apparatus illustrated in FIG. 1.
Figure 6:
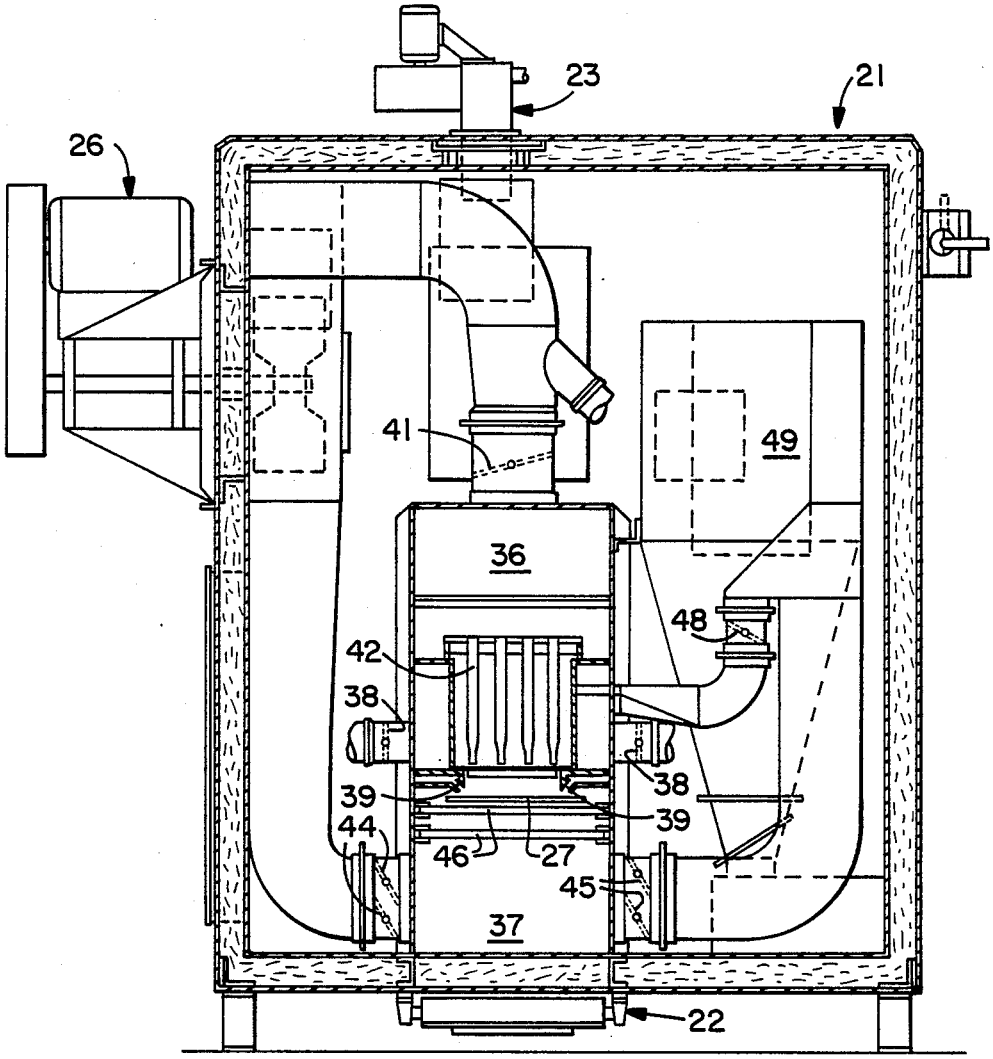
FIG. 6 is a transverse cross-sectional view generally through the embodiment shown in FIG. 5.

Further details of an apparatus structure suitable for proceeding in accordance with this invention are illustrated in FIGS. 5, 6 and 7. A plurality of the tubular directing devices 42 are shown, each with a tapering tip having a reduced inner diameter. Such directing devices 42 typically run substantially the entire length of each treatment zone within the enclosure assembly 21. Details of the preferred woven metal endless belt 27 as discussed herein are also shown.

Figure 8:
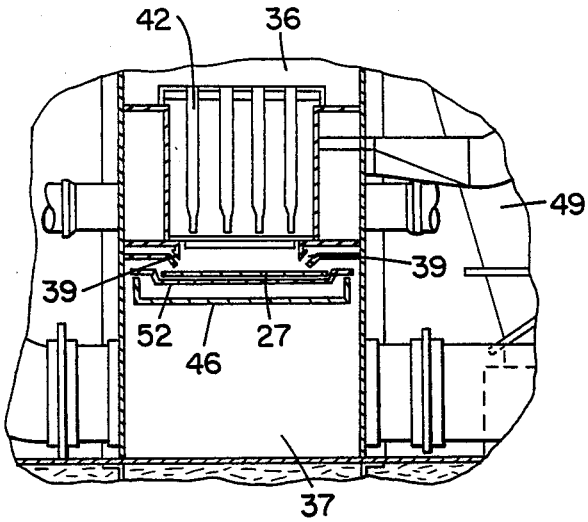
FIG. 8 is a partial transverse cross-sectional view illustrating an optional feature.

With reference to FIG. 8, this illustrates a situation which could be practiced if it would be desired to convert the present apparatus to one more closely resembling a classical type of impingement structure. A substantially flat, elongated and imperforate plate 52 can be positioned substantially directly beneath the foraminous endless belt 27 at those locations at which the belt 27 is in its pathway under the tubular directing devices 42. By this option, the perforated endless belt is substantially transformed, from an operational point of view, into an imperforate moving surface.

Figure 9:
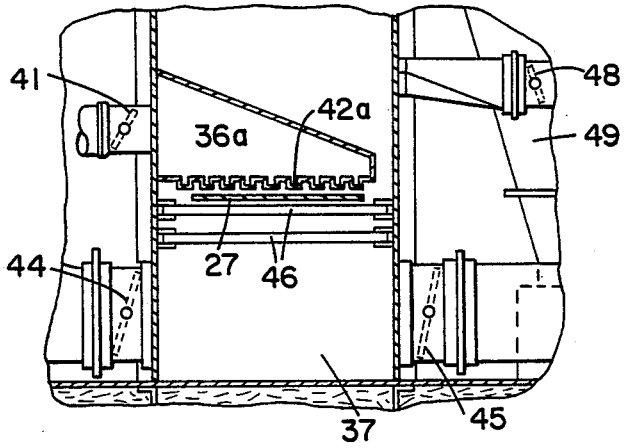
FIG. 9 is a partial transverse cross-sectional view illustrating an alternative embodiment.

Concerning FIG. 9, the directing devices of this embodiment take the form of a plurality of constricted openings **42*a* on the bottom side of an upper plenum 36*a*. Treatment gas enters the plenum 36*a* when the damper or valve 41 is opened. Flow into the lower plenum 37 passes through damper or valve 44. Exit from above the foraminous belt 27 occurs when damper or valve 48 is opened, and exit from the lower plenum 37 is through the damper or valve 45**.

Figure 10:
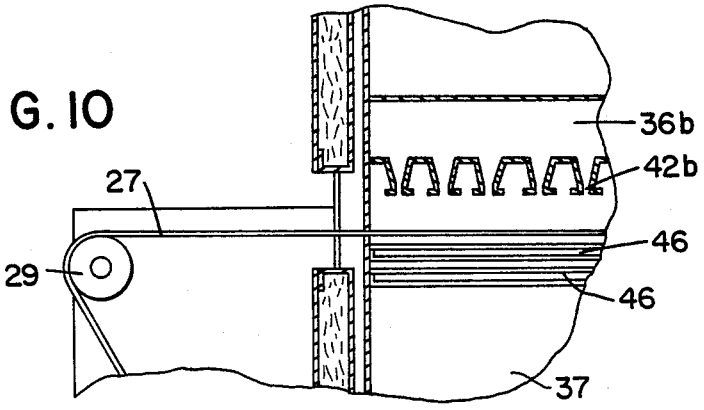
FIG. 10 is a partial longitudinal cross-sectional view illustrating a further possible embodiment.

Regarding the embodiment which is illustrated in FIG. 10, an upper plenum **36*b* is illustrated. A plurality of directing devices 42*b* are positioned along the bottom surface of the plenum 36*b*. These directing devices 42*b* take the form of elongate transverse slots which direct treatment gases generally downwardly onto the foraminous conveyor belt 27** when the downward mode or the fluidization mode of this embodiment is practiced.

While general reference herein has been made to dry cereal processing procedures, and especially with respect to conditions that are met for existing dry cereal manufacturing, it should be borne in mind that the versatility afforded by the present invention is of greater scope than this. For example, because of the ease of use and cost-effective operational capabilities of this invention, novel operations are contemplated. One possibility is single sided coating of dry cereal types of products or dry cereal processing that embodies a combination of toasting, then coating and then drying operations in a single piece of equipment.

It will be understood that the embodiments of the present invention which have been described are illustrative of some of the applications of the principles of the present invention. Numerous modifications may be made by those skilled in the art without departing from the true spirit and scope of the invention.

I claim:

1. A multioperational apparatus for treating particulate products, comprising:

enclosure means for providing a controllable atmospheric environment;

conveyor means for transporting particulate materials through said enclosure means, said conveyor means including a foraminous belt having a lower surface and an upper surface for supporting the particulate materials;

means for providing treating gas to said enclosure means;

means for flowing said treating gas and for selectively directing the treating gas substantially downwardly toward said foraminous belt, said downwardly directing means including means for varying the flow rate of the treating gas, including substantially stopping said substantially downwardly directed gas flow when desired;

means for flowing said treating gas and for selectively directing same to a lower plenum that communicates with the lower surface of said foraminous belt in order to selectively direct the treating gas upwardly toward said foraminous belt, said flowing means that upwardly directs including means for varying the flow rate of the treating gas to said lower plenum and for varying the pressure within the lower plenum, including stopping the upwardly directed flow when desired;

selectively openable and closeable upper exhaust means located above the foraminous belt for selectively providing outflow of treating gas from said enclosure means at a location above the foraminous belt;

selectively openable and closeable lower exhaust means located below the foraminous belt for selectively providing outflow of treating gas from said enclosure means at a location below the foraminous belt;

said apparatus has a downflow mode wherein said lower exhaust means, is open and wherein said upper exhaust means is substantially closed, said downflow mode circulating the treating gas from said downwardly directed gas flow, through said foraminous belt and out of said lower exhaust means;

said apparatus has an upflow mode wherein said upper exhaust means is open and wherein said lower exhaust means is substantially closed, said upflow mode circulating the treating gas from said upwardly directed gas flow, through said foraminous belt and out of said upper exhaust means; and said apparatus has a fluidized bed mode wherein said upper exhaust means is open, wherein said means for flowing the treating gas to the lower plenum and said lower exhaust means are adjusted so as to maintain a treating gas pressure within said lower plenum that is adequate to offset said substantially downwardly directed gas flow to an extent that fluidized bed conditions are provided for particulate materials on said foraminous belt.

2. The multioperational apparatus according to claim 1, wherein said means for providing treating gas includes providing treating gas that is heated air, and wherein said flowing means pressurizes the heated air.

3. The multioperational apparatus according to claim 1, wherein said foraminous belt is a woven metal wire belt that is longitudinally bendable.

4. The multioperational apparatus according to claim 1, wherein said downwardly directing means includes a plurality of generally elongated tubes through which the treating gas flows generally downwardly.

5. The multioperational apparatus according to claim 1, wherein said downwardly directing means includes a plurality of constricted openings on a bottom side of an upper plenum.

6. The multioperational apparatus according to claim 1, wherein said downwardly directing means includes a plurality of elongated transverse slots on a bottom side of an upper plenum.

7. The multioperational apparatus according to claim 1, wherein said lower exhaust means opens into said lower plenum.

8. The multioperational apparatus according to claim 1, wherein said lower plenum has a generally open upper end that is located substantially beneath said lower surface of the foraminous belt.

9. The multioperational apparatus according to claim 1, wherein during said fluidizing bed mode said downwardly directed gas flow impinges upon said treating gas pressure of the lower plenum at a location generally along said foraminous belt, whereby said downwardly directed gas flow generally changes direction to provide a substantially upwardly directed flow of treating gas that treats the particulate materials and flows through said upper exhaust means.

10. The multioperational apparatus according to claim 1, wherein said lower plenum has a generally open upper end that is located substantially beneath said lower surface of the foraminous belt, and said treating gas pressure of the lower plenum provides a generally horizontal curtain of treating gas generally at said foraminous belt, and wherein during said fluidized bed mode said downwardly directed gas flow impinges upon said generally horizontal curtain in order to provide said fluidized bed conditions.

11. The multioperational apparatus according to claim 1, wherein during said fluidized bed mode, the upward flow of treating gas from the lower plenum is between aprroximately 30 percent and approximately 80 percent of said substantially downwardly directed gas flow.

12. The multioperational apparatus according to claim 1, wherein during said downflow mode said means for flowing treating gas to the lower plenum is substantially stopped.

13. The multioperational apparatus according to claim 1, wherein during said upflow mode said means for flowing treating gas to said downwardly directing means is substantially stopped.

14. A multioperational apparatus for treating particulate products, comprising:

enclosure means for providing a controllable atmospheric environment;

conveyor means for transporting particulate materials through said enclosure means, said conveyor means including a foraminous belt having a lower surface and an upper surface for supporting the particulate materials;

means for providing treating gas to said enclosure means;

means for flowing said treating gas and for selectively directing the treating gas substantially downwardly toward said foraminous belt, said downwardly directing means including means for varying the flow rate of the treating gas, including substantially stopping said substantially downwardly directed gas flow when desired;

means for flowing said treating gas and for selectively directing same to a lower plenum that communicates with the lower surface of said foraminous belt in order to selectively direct the treating gas upwardly toward said foraminous belt, said flowing means that upwardly directs including means for varying the flow rate of the treating gas to said lower plenum and for varying the pressure within the lower plenum, including stopping the upwardly directed flow when desired;

selectively openable and closeable upper exhaust means located above the foraminous belt for selectively providing outflow of treating gas from said enclosure means at a location above the foraminous belt;

selectively openable and closeable lower exhaust means located below the foraminous belt for selectively providing outflow of treating gas from said enclosure means at a location below the foraminous belt;

a substantially imperforate plate that is selectively positionable and removable from substantially directly under said lower surface of the foraminous belt;

said apparatus has a downflow mode wherein said substantially imperforate plate is removed from under the foraminous belt, said lower exhaust means is open, and said upper exhaust means is substantially closed, and said downflow mode circulates the treating gas downwardly through said foraminous belt and out of said lower exhaust means;

said apparatus has an upflow mode wherein said substantially imperforate plate is removed from under the foraminous belt, said upper exhaust means is open, and said lower exhaust means is substantially closed, and said upflow mode circulates the treating gas upwardly through the foraminous belt and out of said upper exhaust means; and said apparatus has a fluidized bed mode wherein said substantially imperforate plate is positioned substantially directly under said lower surface of the foraminous belt, and said upper exhaust means is open.

15. The multioperational apparatus according to claim 14, wherein during said fluidized bed mode the downwardly directed gas flow impinges upon the substantially imperforate plate.

16. The multioperational apparatus according to claim 14, wherein during said downflow mode said means for flowing treating gas to the lower plenum is substantially stopped.

17. The multioperational apparatus according to claim 14, wherein during said upflow mode said means for flowing treating gas to said downwardly directing means is substantially stopped.

18. A multioperational method for treating particulate products, comprising:

providing a controllable environment and transporting particulate materials therethrough on a moving foraminous belt having a lower surface and an upper surface for supporting the particulate materials;

flowing treating gas from a supply of treating gas and selectively directing same downwardly toward the upper surface of the moving foraminous belt through an upper flow path, upwardly toward the lower surface of the moving foraminous belt through a lower flow path, or through both the upper and lower flow paths toward the upper and lower surfaces of the moving foraminous belt;

selectively exhausting treating gases from the controllable environment at a location below the lower surface of the moving foraminous belt, above the upper surface of the moving foraminous belt, or both below and above the moving foraminous belt;

whereby said multioperational method includes selecting among any of the following circulation procedures:

circulating said treating gas including downflowing same by said selectively directing step downwardly toward and through the moving foraminous belt, exhausting same at the location below the moving foraminous belt and returning substantial quantities of the thus exhausted treating gas to the supply of treating gas; and circulating said treating gas including upflowing same by said selectively directing step upwardly toward and through the moving foraminous belt, exhausting same at a location above the moving foraminous belt and returning substantial quantities of the thus exhausted treating gas to the supply of treating gas; and circulating said treating gas to achieve fluidization, including downflowing same by said selectively directing step downwardly toward the moving foraminous belt, upflowing the treating gas by said selectively directing step upwardly toward the moving foraminous belt, and selecting said step of exhausting treating gases from above the upper surface of the moving foraminous belt and returning substantial quantities of the thus exhausted treating gas to the supply of treating gas, said downflowing step and said upflowing step occurring substantially simultaneously at substantially the same portions of the moving foraminous belt, said upflowing step maintaining a flow of treating gas that is adequate to offset said downflowing step to the extent that said upflowing step, said downflowing step and said selected upper exhausting step cooperate in fluidizing particulate materials on the moving foraminous belt.

19. The multioperational method according to claim 18, wherein said step of selectively upwardly directing treating gas includes flowing treating gas into a lower plenum having an upper surface that opens into the lower surface of the moving foraminous belt, thereby imparting a elected pressure to treating gas within the lower plenum.

20. The multioperational method according to claim 19, wherein said selected pressure of the lower plenum treating gas is between approximately 30 percent and approximately 80 percent of the flow of treating gas of said step of selectively downwardly directing treating gas.

21. The multioperational method according to claim 18, wherein the flow of treating gas in said step of selectively upwardly directing treating gas is between approximately 30 percent and approximately 80 percent of the flow of treating gas in said step of selectively downwardly directing treating gas.

22. The multioperational method according to claim 18, wherein said upflow circulating procedure includes carrying out said selective exhausting step substantially completely at the location above the upper surface of the moving foraminous belt.

23. The multioperational method according to claim 18, wherein said downflow circulating procedure includes carrying out said selective exhausting step substantially completely at the location below the lower surface of the moving foraminous belt.

24. The multioperational method according to claim 18, wherein said fluidization circulating procedure includes carrying out said selective exhausting step substantially completely at the location above the upper surface of the moving foraminous belt.

25. The multioperational method according to claim 18, wherein said supply of treating gas is subjected to a heating step.

26. The multioperational method according to claim 18, wherein said fluidization circulating procedure includes providing a generally horizontal curtain of treating gas generally at the moving foraminous belt.

27. The multioperational method according to claim 18 wherein said step of transporting particulate materials transports particulates being processed into dry cereal products.

28. The multioperational method according to claim 18 wherein said fluidization circulating procedure includes tumbling the particulate materials.

29. The multioperational method according to claim 18, further including monitoring and controlling said flowing steps and said exhausting steps in order to maintain predetermined flows of treating gas.

* * * * *